United States Patent [19]

Bonerb et al.

[11] Patent Number: 4,603,795

[45] Date of Patent: Aug. 5, 1986

[54] CENTER UNLOADING BIN FOR STORING FREE-FLOWING GRANULAR MATERIAL WITH SIDE CONVEYOR DISCHARGE

[76] Inventors: Vincent C. Bonerb, P.O. Box 200, North Conway, N.H. 03860; Vincent C. Bonerb, P.O. Box 2016, Buffalo, N.Y. 14219

[21] Appl. No.: 357,589

[22] Filed: Mar. 12, 1982

Related U.S. Application Data

[63] Continuation-in-part of Ser. No. 257,604, Apr. 27, 1981, Pat. No. 4,421,250, which is a continuation-in-part of Ser. No. 307,089, Sep. 30, 1981, Pat. No. 4,449,646.

[51] Int. Cl.[4] ..... B65D 88/62

[52] U.S. Cl. ..... 222/262; 222/386.5; 222/389; 222/413; 52/2; 52/197; 414/326

[58] Field of Search ..... 222/386.5, 413, 95, 222/105, 203, 262, 389; 414/304, 326, 327; 52/197, 2

[56] References Cited

U.S. PATENT DOCUMENTS

| | | | |
|---|---|---|---|
| 2,551,216 | 5/1951 | Martin | 52/197 X |
| 2,722,171 | 11/1955 | Deringer | 222/386.5 X |
| 2,956,839 | 10/1960 | Hermanns | 414/304 X |
| 3,071,061 | 1/1963 | Collins et al. | 52/197 X |

FOREIGN PATENT DOCUMENTS

| | | | |
|---|---|---|---|
| 1089874 | 11/1967 | United Kingdom | 222/386.5 |
| 1144162 | 3/1969 | United Kingdom | 52/197 |

*Primary Examiner*—Joseph J. Rolla
*Assistant Examiner*—Frederick R. Handren
*Attorney, Agent, or Firm*—Bernard, Rothwell & Brown

[57] ABSTRACT

A bin for storing and discharging free-flowing granular material such as sugar has a flexible, inflatable double-walled cup-shaped bag resting on the bin floor with the discharge opening in the bottom and a conveyor for discharging to the bin side above the bin floor. In one embodiment, the bin has at least a partial false floor built up to the level of the conveyor. In another embodiment the conveyor is in an upwardly inclined tunnel shaped enclosure.

6 Claims, 4 Drawing Figures

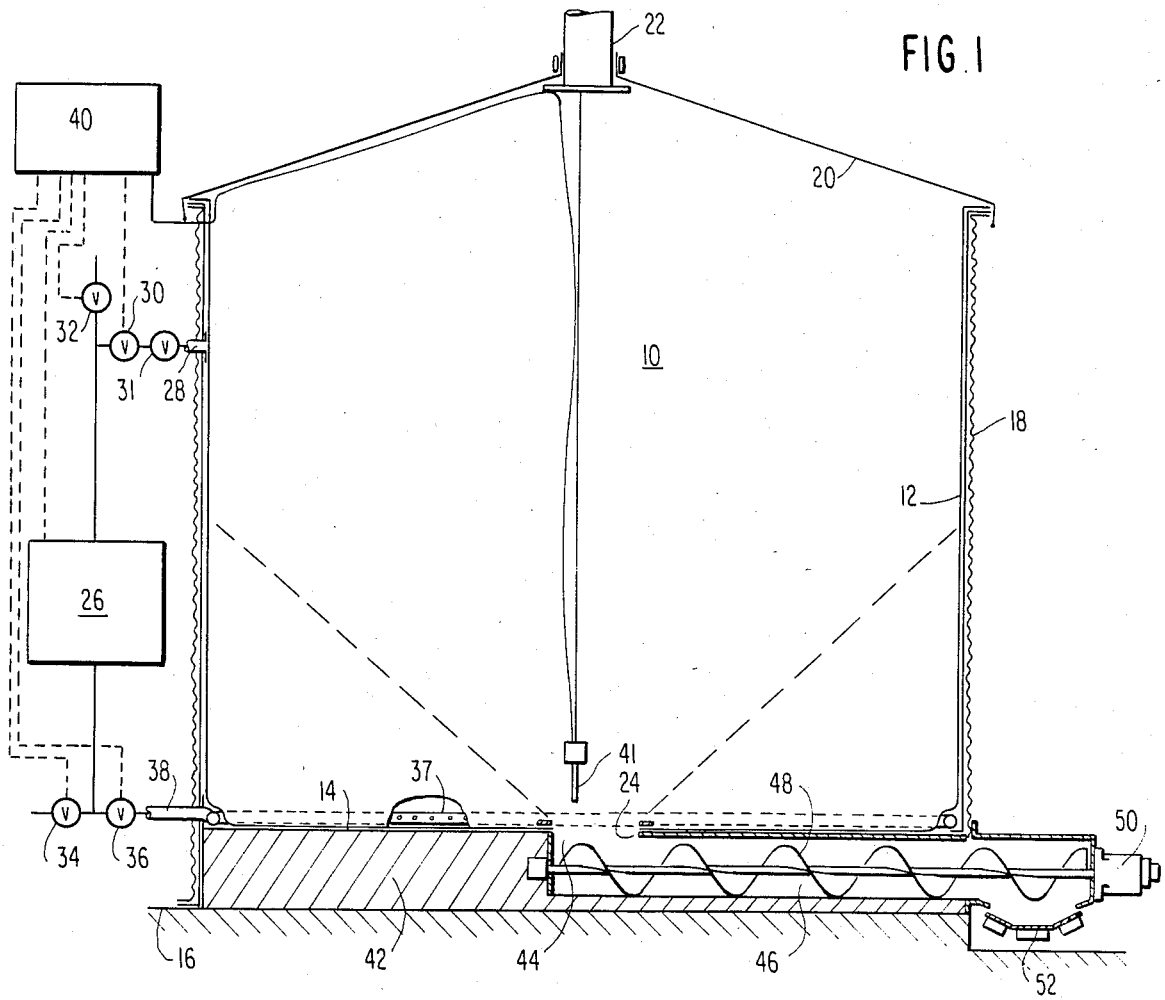
FIG. 1
FIG. 4
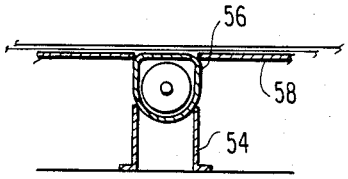
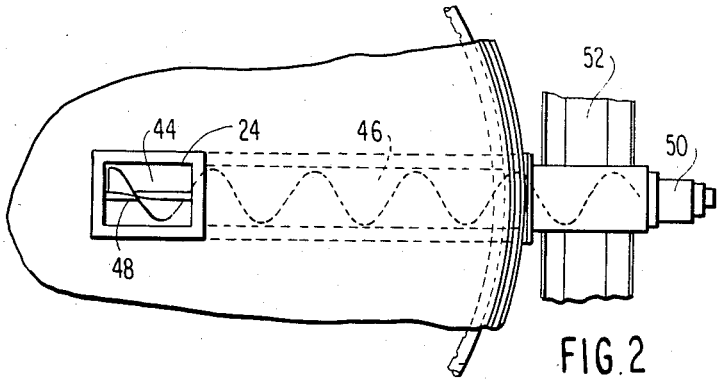
FIG. 2
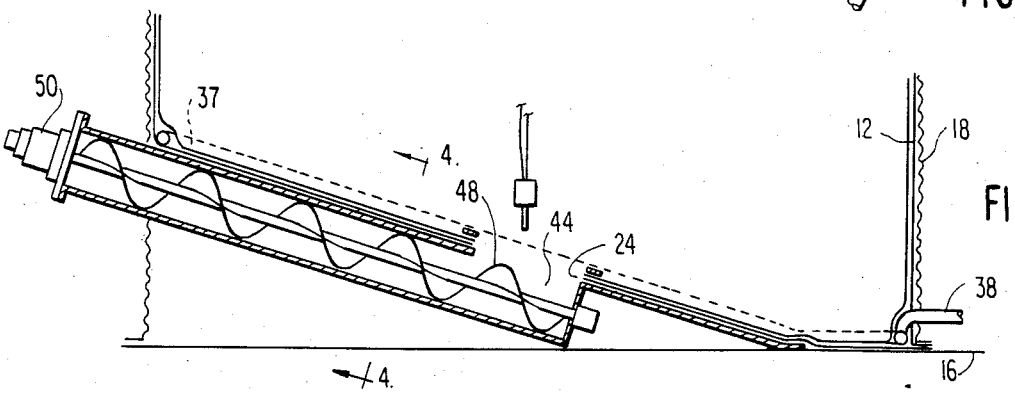
FIG. 3

CENTER UNLOADING BIN FOR STORING FREE-FLOWING GRANULAR MATERIAL WITH SIDE CONVEYOR DISCHARGE

CROSS-REFERENCED TO RELATED APPLICATIONS

This is a continuation-in-part of our prior applications identified as follows:

Ser. No. 257,604
Filed: Apr. 27, 1981, now U.S. Pat. No. 4,421,250
Titled: BIN FOR FREE-FLOWING MATERIAL;

Ser. No. 307,089
Filed: Sept. 30, 1981, now U.S. Pat. No. 4,449,646
Titled: BIN FOR STORING AND DISCHARGING FREE-FLOWING AND GRANULAR MATERIAL;

BACKGROUND

1. Field of the Invention

This invention relates to improvements in flexible, inflatable wall storage bins with fluid pressure-assisted discharge and particularly to improvements in such bins having a center discharge with conveyor unloading to the side of the bin above the support floor.

2. Prior Art

Numerous patents in the prior art illustrate utilization of a fluid pressure-assisted discharge from storage utilizing a flexible membrane. Examples of such prior art are shown in U.S. Pat. Nos. 2,792,262; 2,956,839; 3,209,894; 3,396,762; and 3,421,663.

Our prior applications, particularly applications Ser. No. 257,604 and 307,089, of which this application is a continuation-in-part, disclose the use of flexible, inflatable cup-shaped bags functioning as a storage bin on a flat horizontal surface and utilize fluid pressure for inflating the bag to move the bag wall to assist in gravity discharge of the material after it assumes its angle of repose.

In the work on our prior inventions, we have found that in certain situations it is desirable to have such storage bins unload to the side on the same floor on which the bin sits. This eliminates the need for providing an opening in the floor and enables a bin to sit on a ground floor. However, it is also desirable to locate the discharge in the center of the bin to increase the bin capacity. We are aware of no prior art which provides the advantages of center discharge and side unloading for such bins.

SUMMARY OF THE INVENTION

This invention improves upon the prior art and provides a center discharge side-unloading bin which does not require a hole in the bottom of the supporting floor. This is accomplished by providing a false, or raised, floor to create a discharge well at least in the discharge area of the center of the bin and an elongated, closed casing conveyor extending from: this raised discharge well to the side of the bin.

The invention is disclosed in two embodiments; in one, there is a raised false floor defining a discharge well in the center of the bin; and in the other embodiment there is a false floor with a discharge well in the center and a radially extending tunnel shield for the conveyor.

BRIEF DESCRIPTION OF THE DRAWINGS

FIG. 1 is a partially schematic side sectional elevation view of the center discharge side unloading bin of this invention.

FIG. 2 is a partial plan view looking down into the bin showing the discharge well and the conveyor.

FIG. 3 is a partial sectional elevation view similar to a portion of FIG. 1 showing an alternative embodiment.

FIG. 4 is a sectional view taken along line 4—4 of FIG. 3.

DETAILED DESCRIPTION OF PREFERRED EMBODIMENTS

A bin 10 is formed from a double walled flexible inflatable bag 12 which has a cup shape with a bottom portion 14 which in turn in rests on a supporting floor 16. A bag supporting side wall 18 may conveniently be cylindrical and made of corrugated galvanized metal from which farm buildings are made. The bin may have a top 20 with a filling opening or spout 22 and a center discharge opening 24 at the bottom. In general, the construction of the bin as described to this point is as in our prior applications Ser. No. 257,604 and Ser. No. 307,089. The operation is also similar in that the bag 12 is gradually inflated to assist the gravity discharge of materials after the angle of repose is reached, or just before it is reached.

As shown in FIG. 1 there is an air compressor or blower 26 for providing the small amount of air pressure required through inflatable opening 28 under the control of valves 30, 32, 34 and 36. Deflation opening 38 is connected to a perforated annular vacuum hose 37 at the outer periphery of the interior of the bottom of the double walled bag. All of the valves are automatically controlled through control panel 40 which in turn is operated in response to a material sensor 41 suspended over the center discharge opening 24. When the sensor senses no material at its probe the bag is inflated. Then material is allowed to flow by gravity. This action is cyclic during the discharge. To inflate the bag valves 30 and 34 are open, valves 32 and 36 are closed. To deflate the bag valves 34 and 30 are closed and valves 36 and 32 are open. A check valve 31 is provided to prevent the inflated bag from deflating when the fan is turned off during the discharge cycle.

The bin while having a center discharge rests on a solid horizontal floor 16 and it is undesirable to have the discharge through the floor as this requires breaking and making a hole in the floor. In the FIG. 1 and 2 embodiment the floor of the bin under bag bottom 14 is provided with a false floor 42 and it has a hollow space 44 directly beneath the center discharge opening 24 forming a discharge well in the center. A radially extending hollow space 46 extends outwardly from discharge well 44 and a conveyor 48 of a commercially available motor driven screw type is placed within the space 46. A motor 50 drives the conveyor which conveys the material from the well 44 to a discharge 52 outside the wall of bin 18 and beneath the conveyor outlet.

The embodiment shown in FIG. 3 and 4 is a similar concept except that the conveyor 48 extends not only radially outwardly from a center discharge well 44 but also upwardly for discharging sufficiently above the level of floor 16. In that case the conveyor is supported in its inclined position by supports 54 which support conveyor housing 56 and a segment 58 of the floor is provided flush with the top of the conveyor housing.

As can be seen there is disclosed above an invention in which a fluid assisted discharge bin for storing and handling free-flowing granular material having a center discharge (which has the advantages of capacity and simplicity) is also provided with the advantage of side discharge above the floor level.

We claim:

1. A bin for storing and discharging free-flowing granular material on a bottom capable of supporting the weight of the stored free-flowing granular material, the bin including a flexible inflatable fluid impervious double-walled cup-shaped bag having a bottom with a central discharge opening and side walls, the top of the side walls of the cup-shaped bag being always above the maximum height of material in the bin after it has discharged by gravity through a central discharge opening to assume its angle of repose, a rigid outer bin wall, means to inflate a space between the double walls of the bag, with the improvements comprising; means defining a hollow space discharge well in the bottom center of the bin above the level of the support floor, the central discharge opening in the bottom of the cup-shaped bag attached to the means defining a hollow space discharge well in the bottom of the bin, a conveyor extending from the hollow space discharge well bottom center of the bin to outside and through the bin side wall means and above the level of the support floor.

2. A bin as defined in claim 1 wherein the means defining a hollow space discharge well in the center of the bin is a raised false floor on the bin bottom with a hollow space in the center for bin discharge and a hollow space extending radially outwardly to the bin wall to accommodate the conveyor.

3. A bin as defined in claim 2 wherein the false floor is raised a distance at least equal to the height of the conveyor and the radially extending hollow space has a width at least equal to the width of the conveyor.

4. A bin as defined in claim 3 wherein the conveyor is a screw conveyor in a tubular casing.

5. A bin as defined in claim 1 wherein the means defining the hollow space discharge well is an opening into the end of a sheath covering the conveyor.

6. A bin as defined in claim 5 wherein the conveyor extends upwardly from the center of the bin bottom to discharge through the bin side wall means at a level above the supporting floor.

* * * * *

UNITED STATES PATENT AND TRADEMARK OFFICE

CERTIFICATE OF CORRECTION

PATENT NO. : 4,603,795

DATED : August 5, 1986

INVENTOR(S) : Timothy C. Bonerb et al.

It is certified that error appears in the above-identified patent and that said Letters Patent is hereby corrected as shown below:

On the first page of the patent, block [76], containing the inventor's information, the first occurence of Vincent C. Bonerb should be deleted and Timothy C. Bonerb be substituted therefor so that the correct identification of the inventor's block will read in full:

--Inventors: Timothy C. Bonerb, P.O. Box 2016 North Conway, N.H. 03860; Vincent C. Bonerb, P.O. Box 2016, Buffalo, N.Y. 14219--

Signed and Sealed this

Third Day of February, 1987

*Attest:*

*Attesting Officer*

DONALD J. QUIGG

*Commissioner of Patents and Trademarks*